United States Patent [19]

Charlton et al.

[11] Patent Number: 4,614,010

[45] Date of Patent: Sep. 30, 1986

[54] SAFETY BELT BUCKLE

[75] Inventors: Keith D. Charlton, Midland; Anthony S. Bracnik, Penetanguishene; Kenneth M. Forget, Lafontaine, all of Canada

[73] Assignee: TRW Inc., Cleveland, Ohio

[21] Appl. No.: 740,725

[22] Filed: Jun. 3, 1985

[51] Int. Cl.[4] ..... A44B 11/25

[52] U.S. Cl. ..... 24/639; 24/635; 24/640; 24/642

[58] Field of Search ..... 24/635, 639, 640, 642, 24/650

[56] References Cited

U.S. PATENT DOCUMENTS

| | | | |
|---|---|---|---|
| 3,605,210 | 9/1971 | Lohr | 24/635 |
| 3,760,467 | 9/1973 | Lohr | 24/639 |
| 4,094,046 | 6/1978 | Takada | 24/642 |
| 4,181,832 | 1/1980 | Ueda | 24/635 |
| 4,228,567 | 10/1980 | Ikesue et al. | 24/642 |
| 4,301,576 | 11/1981 | Cunningham | 24/640 |
| 4,380,100 | 4/1983 | Crisp | 24/642 |

FOREIGN PATENT DOCUMENTS

| | | | |
|---|---|---|---|
| 2080387 | 2/1982 | United Kingdom | 24/640 |

*Primary Examiner*—Victor N. Sakran

*Attorney, Agent, or Firm*—Yount & Tarolli

[57] ABSTRACT

An improved subassembly can be used in either a top release buckle or an end release buckle. The subassembly includes an elongated metal base. A latch bar is pivotally supported in openings in side portions of the base for movement between an engaged condition and a disengaged condition. A slide is movable along the base to move the latch bar between the engaged and disengaged conditions and to hold the latch bar in the engaged condition. The slide has a pair of side sections which are engaged by either the actuator pad of a top release buckle or the actuator slide of an end release buckle. The side sections of the slide have cam surfaces which move the latch bar between the engaged and disengaged conditions. The side sections of the slide member have blocking surfaces which hold the latch bar in the engaged condition. An ejector member ejects a safety belt tongue from a buckle upon movement of the latch bar to the disengaged condition and blocks movement of the latch bar from the disengaged condition until the tongue is again inserted into the buckle.

36 Claims, 17 Drawing Figures

SAFETY BELT BUCKLE

BACKGROUND OF THE INVENTION

The present invention related to a buckle or a safety belt and more specifically to an apparatus which can be used in either a top or an end release buckle.

Top release buckles may be preferred for use with safety belts for the rear seat of a vehicle. End release buckles may be preferred for use with safety belts for the front seat of a vehicle. These two different types of buckles have previously used different subassemblies to engage the tongue of a safety belt. A top release buckle has a subassembly which is actuated to release the tongue of a safety belt by manually depressing a pad on the top of the buckle. An end release buckle has a subassembly which is actuated to release the tongue of a safety belt by manually moving a slide at one end of the buckle.

The use of different subassemblies for top and end release buckles complicates the manufacture and assembly of the buckles. Thus, an inventory of one set of parts must be maintained for the subassembly of a top release buckle and an inventory of another set of parts must be maintained for the subassembly of an end release buckle. Due to the different constructions of the subassemblies, the mode of assembly of the top and end release buckles is different.

BRIEF SUMMARY OF THE PRESENT INVENTION

The present invention provides a subassembly which can be used in either a top release buckle or an end release buckle. The subassembly includes an elongated base and a spring biased pivotal latch bar. A slide engages outwardly projecting end portions of the latch bar and is movable along the base to move the latch bar between engaged and disengaged conditions.

When the latch bar is in the engaged condition holding a safety belt tongue in a buckle, a surface on the slide blocks movement of the latch bar to the release condition. This prevents releasing of the safety belt tongue unless the slide is moved. Upon movement of either an actuator pad in a top release buckle or an actuator slide in an end release buckle, the slide is moved along the base to move the latch bar to the disengaged condition to thereby release the safety belt tongue.

Accordingly, it is an object of this invention to provide a new and improved apparatus for use in either a top release buckle or an end release buckle.

Another object of this invention is to provide a new and improved apparatus as set forth above and wherein the appartus includes a latch bar which is disposed on a base and is movable between an engaged condition and a disengaged condition by a slide which can be moved relative to the base by manual depression of either the actuator pad of a top release buckle or the actuator slide of an end release buckle.

Another of this invention is to provide a new and improved buckle for receiving a tongue connected with a safety belt and wherein the buckle includes a latch bar which is movable between an engaged condition and a disengaged condition upon movement of a slide along a base and wherein the slide has a surface to block movement of the latch bar from the engaged condition to the disengaged condition until the slide is actuated to release the tongue of a safety belt.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

General Description

Figure 1:
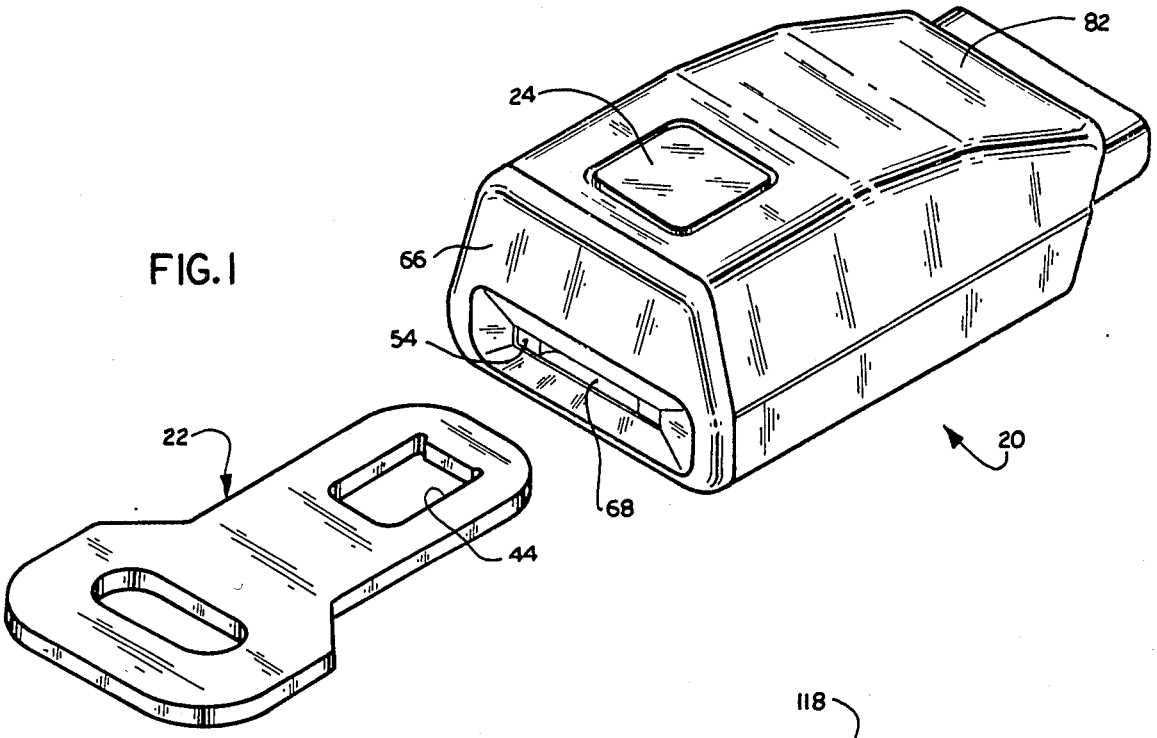
FIG. 1 is a pictorial illustration of a top release buckle and a safety belt tongue prior to insertion of the tongue into the buckle.

Automotive vehicles are fitted with belt systems for restraining movement of an occupant of a vehicle in the event of an accident. Normally, the belts are selectively releasable and engageable about an occupant through use of a buckle and tongue device. A top release buckle 20 (FIG. 1) constructed in accordance with the present invention engages a safety belt tongue 22. The top release buckle 20 has an actuator pad or button 24 in an upper portion of the buckle. The actuator pad 24 is manually depressable and acts through locking elements described below to release the safety belt tongue 22.

An end release buckle 28 (FIG. 2) constructed in accordance with the present invention engages a safety belt tongue 30 to restrain movement of an occupant of a vehicle in the event of an accident. The end release buckle 28 has an actuator slide or button 32 in an end portion of the buckle. The actuator slide 32 is manually movable and acts through locking elements to release the safety belt tongue 30.

Figure 2:
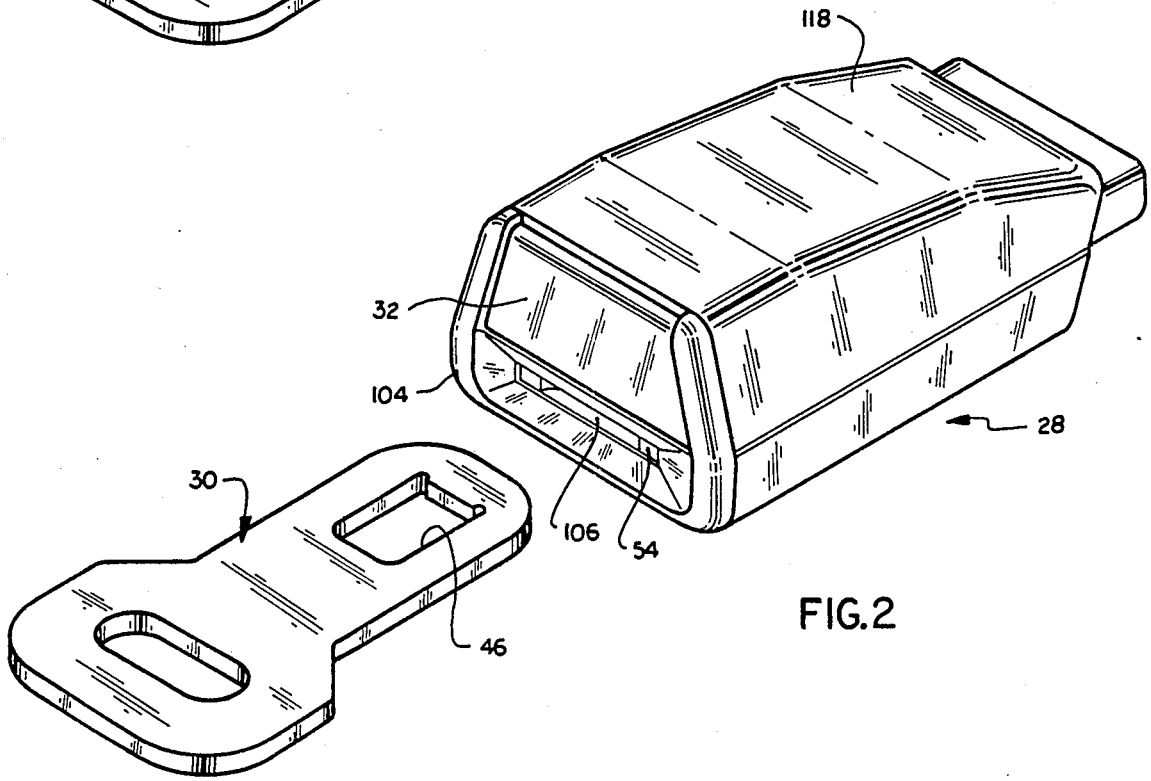
FIG. 2 is a pictorial illustration, generally similar to FIG. 1, of an end release buckle and a safety belt tongue prior to insertion of the tongue into the buckle.

In accordance with a feature of the present invention, subassemblies having the same construction as the subassembly 36 (FIG. 3) are used in both the top release buckle 20 of FIG. 1 and the end release buckle 28 of FIG. 2. The subassembly 36 (FIG. 3) includes an elongated base 40. A latch bar 42 is supported by the base 40 for pivotal movement between an engaged condition and a release condition. When the latch bar 42 is in the engaged condition, it engages an opening 44 or 46 in either the safety belt tongue 22 (FIG. 1) or the safety belt tongue 30 (FIG. 2) to prevent their withdrawal from either the top release buckle 20 or end release buckle 28.

The latch bar 42 is pivoted by movement of a slide 50 axially along the base 40. Thus, movement of the slide 50 along the base pivots the latch bar 42 between the engaged and disengaged conditions. When the latch bar 42 is in the engaged condition, the slide 50 blocks movement of the latch bar to the release condition to prevent withdrawal of a seat belt tongue from the subassembly 36.

The subassembly 36 also includes an ejector 54. The ejector 54 is movable axially along the base 40, under the influence of an ejector spring 56, to eject either the safety belt tongue 22 or the safety belt tongue 30 from the subassembly 36 upon movement of the latch bar 42 to the disengaged condition. As the ejector 54 moves along the base 40 to eject a safety belt tongue from the subassembly 36, the ejector moves beneath the latch bar 42. This allows the ejector 54 to block movement of the latch bar 42 from the release condition to the engaged condition until the subsequent insertion of a safety belt tongue 22 or 30 into the subassembly 36.

When the subassembly 36 is used in the top release buckle 20 (FIG. 1), the subassembly is inserted into a tubular housing 58 (FIG. 4) which partially encloses the base 40 and slide 50. The subassembly 36 is inserted into the housing 58 through an open end 62 in the manner indicated schematically by the arrow 64 in FIG. 4.

The housing 58 has an end wall 66 which defines a narrow slot 68 through which the safety belt tongue 22 is inserted. The housing 58 cooperates with the base 40 to position the base relative to the housing and to hold the base against movement relative to the housing. In addition, the housing 58 guides movement of the slide 50 and ejector 54 (FIG. 3) along the base 40. An upper portion of the housing is provided with arcuate mounting surfaces 72 and 73 in which cylindrical end portions 74 and 75 of the actuator pad 24 are pivotally supported.

A suitable buckle mounting member (not shown), such as a strap, is connected with an end portion 76 of the base 40. The strap is then threaded through a relatively small slot or opening (not shown) in the far end portion 80 of a cover 82. The subassembly 36 and housing 58 are then telescopically inserted through an open end 84 of the cover 82.

The cover 82 is decorative but is also effective to block access to the components of the subassembly 36 and to prevent them from becoming jammed by dirt or other foreign materials. In addition, the cover 82 holds the actuator pad 24 in pivotal engagement with the arcuate mounting surfaces 72 and 73 in the housing 58. Projections or detents 90 on opposite sides of the housing 58 cooperate with corresponding recesses 92 within the cover 82 to prevent removal of the cover.

Once the housing 58 and subassembly 36 have been enclosed by the cover 82, the safety belt tongue 22 (FIG. 1) can be inserted through the slot 68 into the subassembly 36. As the tongue 22 enters the subassembly 36, the ejector 54 moves rearwardly. This allows the latch bar 42 to pivot into engagement with the opening 44 and hold the tongue 22 in the buckle 20.

Figure 3:
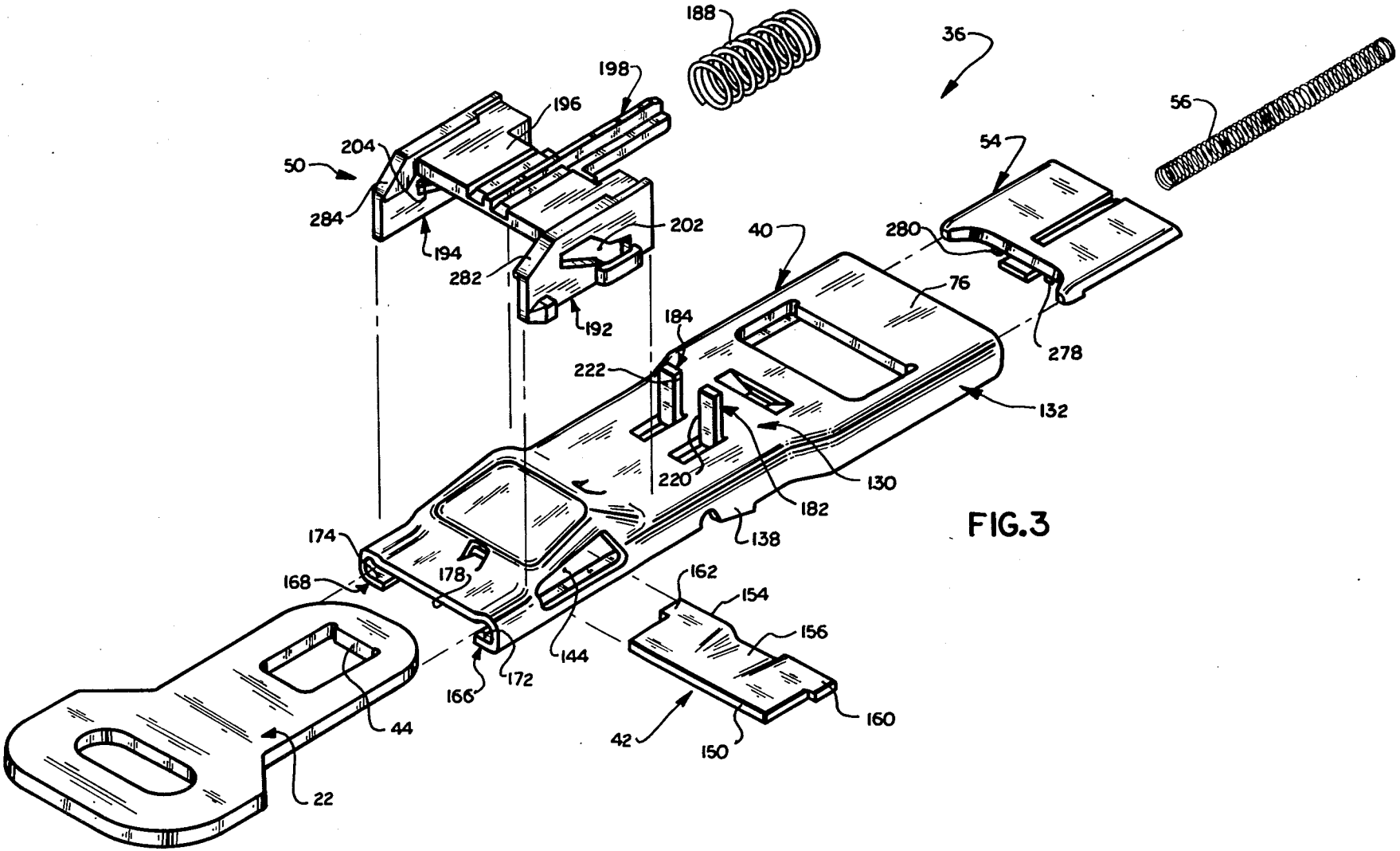
FIG. 3 is an exploded, pictorial illustration of a subassembly which can be used in either the top release buckle of FIG. 1 or the end release buckle of FIG. 2.
Figure 4:
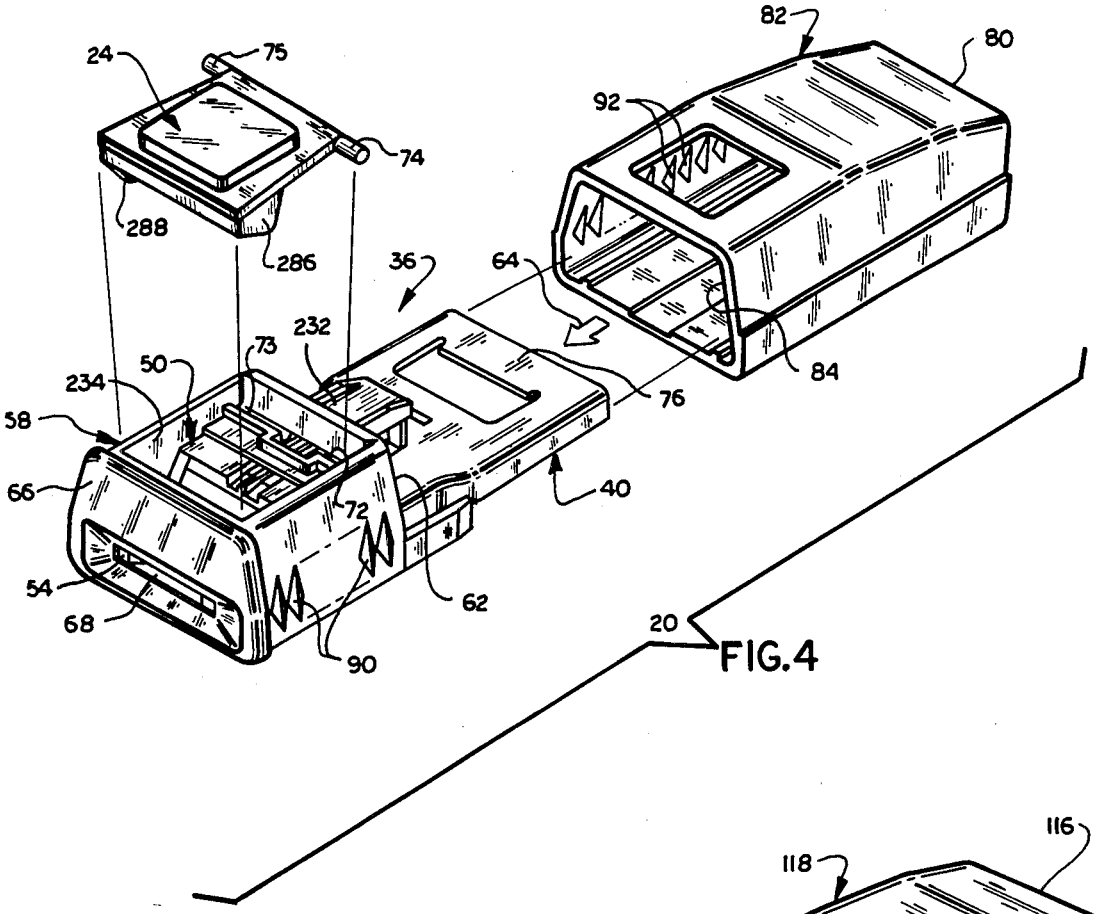
FIG. 4 is a partially exploded illustration depicting the manner in which the subassembly of FIG. 3 is mounted in a tubular housing and then enclosed in a cover of a top release buckle.

When the safety belt tongue 22 is to be removed from the buckle 20, the actuator pad 24 is manually pivoted downwardly (as viewed in FIGS. 1 and 4). As the actuator pad 24 is depressed, the slide 50 moves rearwardly (toward the right as viewed in FIG. 3) to move the latch bar 42 out of engagement with the tongue 22. Once the latch bar 42 has become disengaged from the tongue 22, the ejector 54 moves forwardly and ejects the tongue 22 from the buckle 20.

When the subassembly 36 is used in the end release buckle 28 (FIG. 2), the subassembly is inserted into a tubular housing 98 (FIG. 5) which partially encloses the base 40 and slide 50. The subassembly 36 is inserted into the housing 98 through an open end 102 in the manner indicated schematically by the arrow 103 in FIG. 5.

Figure 5:
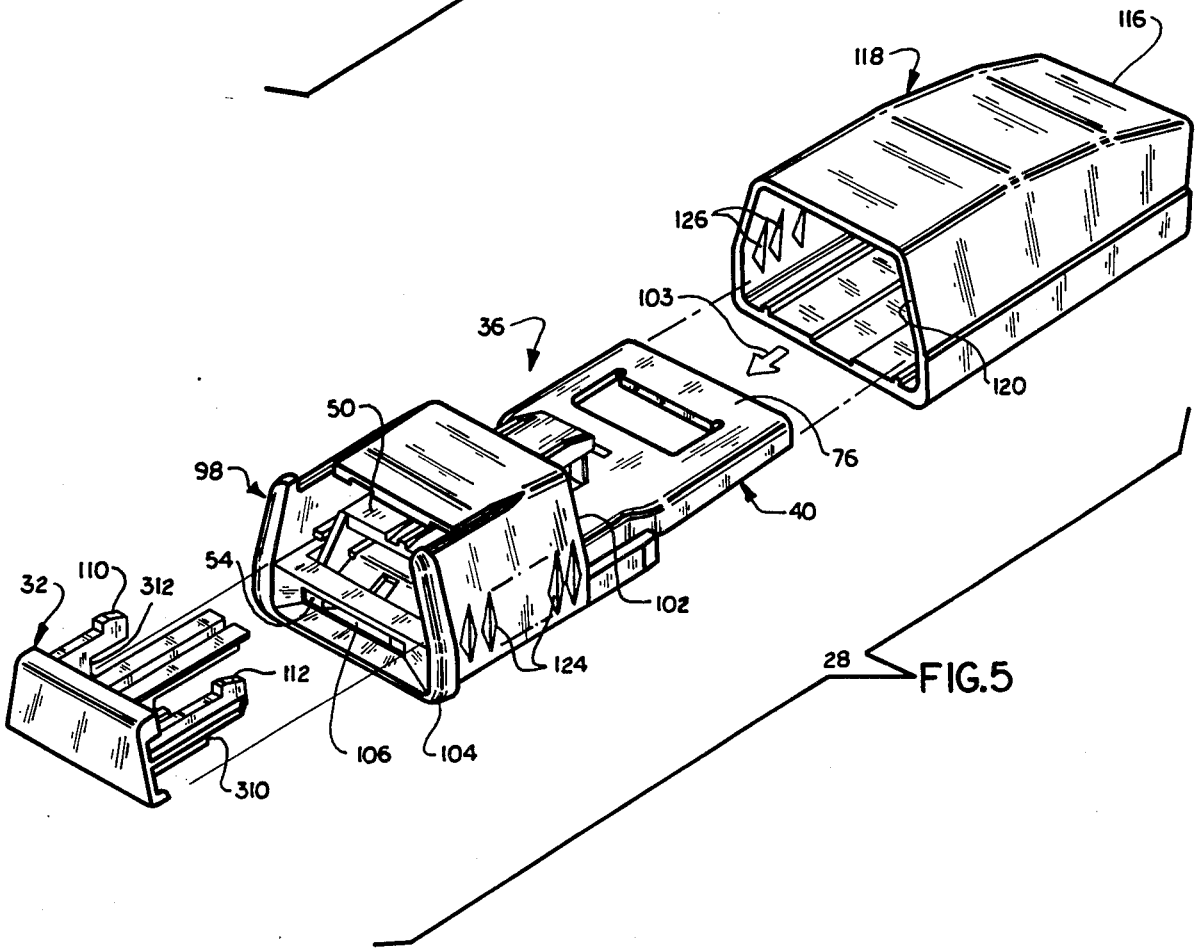
FIG. 5 is a partially exploded illustration depicting the manner in which the subassembly of FIG. 3 is mounted in a tubular housing and then enclosed in a cover of an end release buckle.

The housing 98 has an end wall 104 which defines a narrow slot 106 through which the safety belt tongue 30 is inserted. The housing 98 cooperates with the base 40 to position the base relative to the housing and to hold the base against movement relative to the housing. In addition, the housing 98 guides movement of the slide 50 and ejector 54 (FIG. 3) along the base 40. An end portion of the housing 98 is provided with linear guide tracks (not shown) which guide movement of the actuator slide 32 (FIG. 5).

A suitable buckle mounting member (not shown), such as a strap, is connected with an end portion 76 of the base 40. The strap is then threaded through a relatively small slot or opening (not shown) in the far end portion 116 of a cover 118. The subassembly 36 and housing 98 are then telescopically inserted through an open end 120 of the cover 118.

The cover 118 is effective to block access to the components of the subassembly 36 and to prevent them from becoming jammed by dirt or other foreign materials. Projections or detents 124 on opposite sides of the housing 98 cooperate with corresponding recesses 126 within the cover 118 to prevent removal of the cover.

Once the housing 98 and subassembly 36 have been enclosed by the cover 118, the safety belt tongue 30 (FIG. 1) can be inserted through the slot 106 into the subassembly 36. As the tongue 30 enters the subassembly 36, the ejector 54 moves rearwardly. This allows the latch bar 42 to pivot into engagement with the opening 46 and hold the tongue 30 in the buckle 28.

When the safety belt tongue 30 is to be removed from the buckle 28, the actuator slide 32 is manually pressed inwardly. As the actuator slide 32 is depressed, the slide 50 moves rearwardly (toward the right as viewed in FIG. 3) to move the latch bar 42 out of engagement with the tongue 30. Once the latch bar 42 has become disengaged from the tongue 30, the ejector 54 moves forwardly and ejects the tongue 30 from the buckle 28.

In order to provide for the transmission of relatively large load forces between a safety belt and buckle mounting, the latch bar 42 and base 40 are formed of metal. However, the slide 50, ejector 54, housings 58 and 98, and covers 82 and 118 are molded of suitable polymeric materials to facilitate their manufacture.

Subassembly—Base

Figure 6:
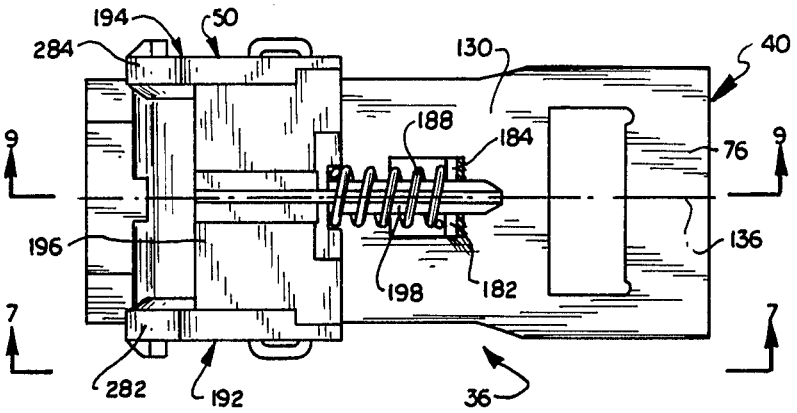
FIG. 6 is a top plan view, on a reduced scale, of the subassembly of FIG. 3 and illustrating the relationship between a slide and base prior to insertion of a safety belt tongue.
Figure 7:
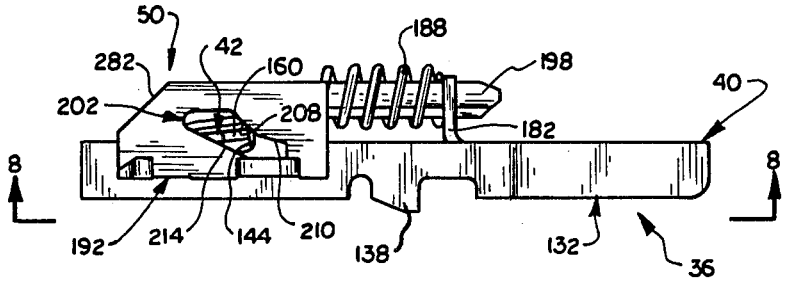
FIG. 7 is a side elevational view, taken generally along the line 7—7 of FIG. 6, further illustrating the relationship between the slide and base.
Figure 8:
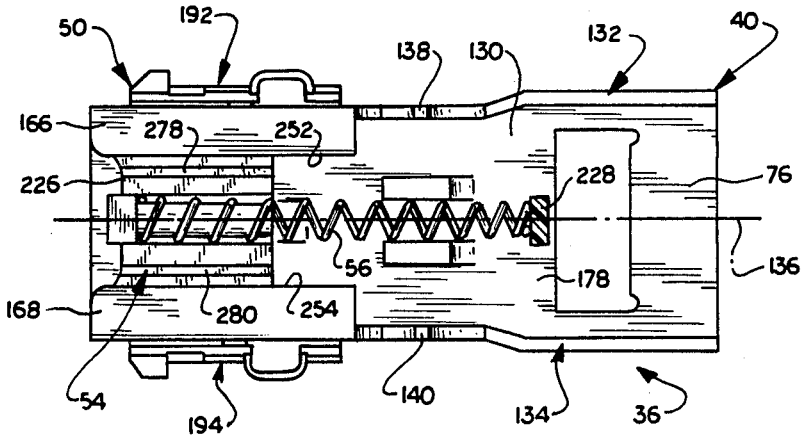
FIG. 8 is a bottom plan view, taken generally along the line 8—8 of FIG. 7, illustrating the relationship between the base and an ejector.

The base 40 is stamped as one piece from sheet metal and includes a flat elongated web portion 130 (FIGS. 3, 6 and 9) and a pair of elongated side portions 132 and 134 (FIGS. 3 and 8). The side portions 132 and 134 extend throughout the length of the base 40 in a direction generally parallel to a longitudinal axis 136 of the base. The side portions 132 and 134 increase the structural rigidity of the base 40 to enable it to withstand relatively large load forces. The side portions 132 and 134 are provided with downwardly (as viewed in FIGS. 3, 7 and 9) projecting mounting tangs or tabs 138 and 140 which engage openings in the top release housing 58 or the end release housing 98 (FIGS. 4 and 5) to fixedly interconnect the base 40 with one of the housings.

Figure 9:
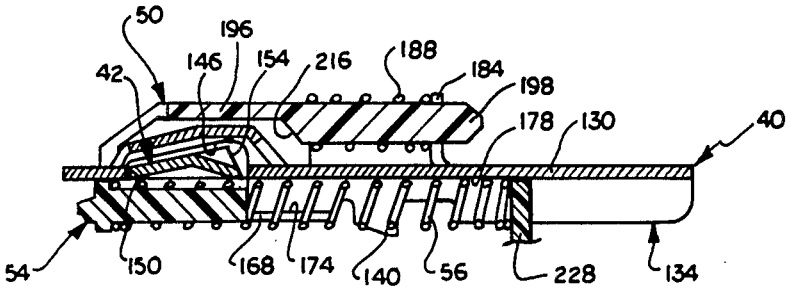
FIG. 9 is a sectional view, taken generally along the line 9—9 of FIG. 6, further illustrating the relationship between the base, latch bar, slide and ejector prior to insertion of a safety belt tongue.
Figure 13:
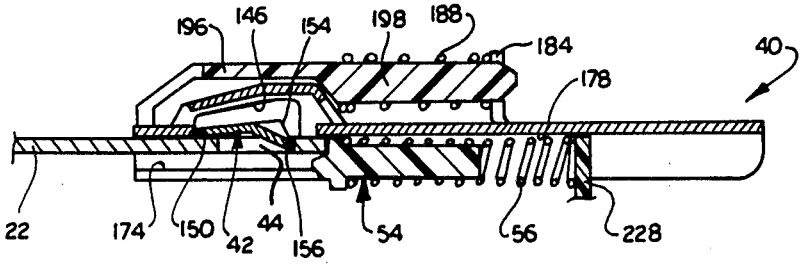
FIG. 13 is a sectional view, generally similar to FIG. 9, and illustrating the relationship between the base, slide, ejector, and the tongue of a safety belt.

The side portions 132 and 134 of the base define a pair of identical apertures 144 and 146 (FIGS. 3 and 9) in which the latch bar 42 is supported for pivotal movement between a release condition (FIG. 9) and an engaged condition (FIG. 13). When the latch bar 42 is in the release condition, it is disposed above the portion of the base 40 which receives the safety belt tongue 22 (FIG. 9). When the latch bar 42 is in the engaged condition, it extends into the opening 44 in the safety belt tongue 22 to hold the tongue in the buckle 20 (FIG. 13).

Figure 12:
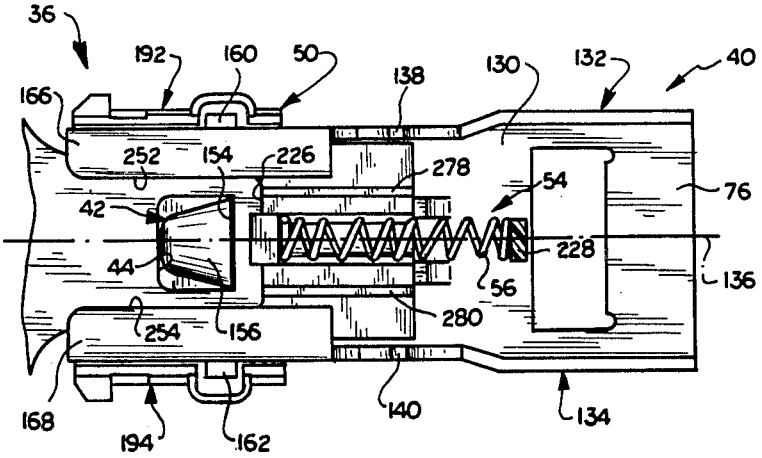
FIG. 12 is a bottom plan view, taken generally along the line 12—12 of FIG. 11, illustrating the relationship between the base, ejector and the tongue of a safety belt.

As the latch bar 42 moves between the release condition of FIG. 9 and the engaged condition of FIG. 13, it pivots in the apertures 144 and 146 about a straight leading edge portion 150 (FIGS. 3, 9 and 13) of the latch bar. The leading edge portion 150 of the latch bar 42 has a length which is slightly greater than the width of the base 40. Therefore, the leading edge portion 150 of the latch bar projects slightly outwardly from and rests on the side portions 132 and 134 of the base 40. A pair of outwardly projecting actuator tabs 160 and 162 (FIG. 3) on the latch bar 42 are engaged by opposite sides of the slide 50 (FIG. 12). A trailing edge portion 154 of the latch bar 42 (FIG. 3) is provided with a detent 156 which engages the opening 44 in the safety belt tongue 22 (FIG. 13) when the tongue is inserted into the buckle.

The side portions 132 and 134 of the base 40 are provided with a pair of in-turned flanges 166 and 168 (FIGS. 3 and 8). The flanges 166 and 168 cooperate with the web portion 130 of the base 40 to define a space which holds the ejector 54 and receives the end of the safety belt tongue 22. Thus, the flanges 166 and 168 have inner side surfaces 172 and 174 (FIG. 3) which extend parallel to a lower or inner side surface 178 (FIGS. 3 and 9) of the web 130. The ejector 54 and/or tongue 22 are held between the inner side surfaces 172 and 174 on the flanges 166 and 168 and the inner side surface 178 of the web 130.

The base 40 is provided with a pair of upstanding spring retaining projections or posts 182 and 184 (FIGS. 3 and 6) which abut one end of a slide spring 188. The slide spring 188 biases or urges the slide 50 toward the leading or outer end of the base 40.

Subassembly—Slide

The slide 50 moves the latch bar 42 between the release condition (FIG. 9) and the engaged condition (FIG. 13). In addition, the slide 50 blocks movement of the latch bar 42 from the engaged condition until either the top release actuator pad 24 or end release actuator slide 32 is depressed.

The slide 50 includes a pair of parallel side sections 192 and 194 (FIGS. 3 and 6) which are interconnected by a bridge section 196. An elongated spring mounting section 198 extends rearwardly between the spring mounting posts 182 and 184. The helical coil spring 188 telescopes over the spring mounting section 198 and is compressed between the bridge portion 196 of the slide 50 and the spring retaining posts 182 and 184.

Figure 10:
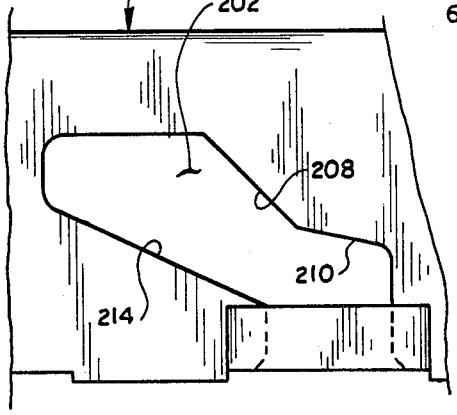
FIG. 10, on sheet six of the drawings, is an enlarged fragmentary view of surfaces disposed on the slide to move the latch bar between engaged and disengaged conditions and to hold the latch bar in the engaged condition.

The side sections 192 and 194 of the slide 50 have identical cam openings 202 and 204 (FIG. 3) which engage the latch bar tabs 160 and 162. Upon movement of the slide 50 along the base 40, the cam openings 202 and 204 apply forces to the latch bar tabs 160 and 162 to move the latch bar between the engaged and release conditions. Thus, the cam opening 202 (FIG. 10) is provided with a cam surface 208 (FIG. 7) which engages the latch bar tab 160. When the latch bar 42 is to be moved from the release condition shown in FIGS. 7 and 9 to the engaged condition shown in FIGS. 11 and 13, the slide 50 is moved forwardly, by the slide spring 188. As this occurs, the cam surface 208 (FIG. 10) forces the latch bar 42 to pivot downwardly from the release condition of FIGS. 7 and 9 to the engaged condition of FIGS. 11 and 13.

Once the latch bar 42 has moved to the engaged condition, a blocking surface 210 (FIG. 10) in the cam opening 202 engages the upper side surface of the latch bar tab 160 to block pivoting movement of the latch bar 42 from the engaged condition back toward the disengaged condition. This insures that once the safety belt tongue 22 has been inserted into the buckle, the tongue is held until it is intentionally released by depressing either the actuator pad 24 or the actuator slide 32.

Figure 11:
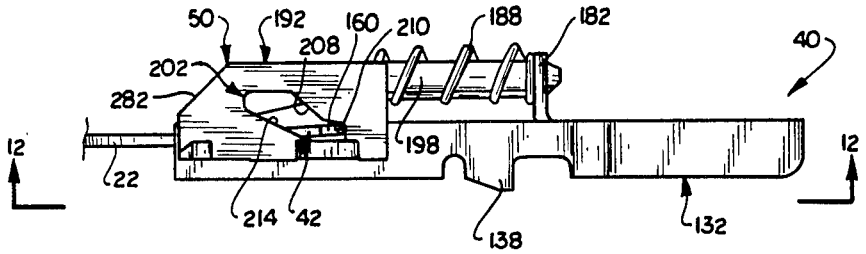
FIG. 11 is a side elevational view, generally similar to FIG. 7, illustrating the relationship between the slide and base after insertion of a safety belt tongue.

When the actuator pad 24 or actuator slide 32 is depressed, force is applied directly to the slide 50 to move the slide rearwardly from the position shown in FIG. 11 to the position shown in FIG. 7. As this occurs, a second cam surface 214 (FIG. 10) engages the locking bar tab 160 to pivot the locking bar 42 upwardly out of engagement with the buckle tongue 22. This releases the buckle tongue for movement out of the buckle 20 under the influence of the ejector 54.

The cam surfaces 208 and 214 are skewed at an acute angle relative to the longitudinal axis 136 of the base 40 to provide a camming action upon movement of the slide 50 along the base. However, the locking surface 210 extends parallel to the longitudinal axis 136 of the base and engages the upper side surface of the latch bar tab 160 to block movement of the latch bar from the engaged position. The movement of the slide member 50 in a forward direction as the latch bar is pivot to the engaged position is limited by engagement of an inner side surface area 216 (FIG. 13) on the slide 50 with the base 40. Rearward movement of the slide 50 is limited by the extent to which the cam surface 214 can pivot the latch bar tab 160 upwardly in the apertures 144 and 146 in the base 40.

Although the foregoing description relates primarily to the manner in which the cam opening 202 cooperates with the latch bar tab 160, it should be understood that the cam opening 204 cooperates with the latch bar tab 162 in the same manner. Thus, the cam opening 204 has surfaces corresponding to the blocking surface 210 and cam surfaces 208 and 214 of the cam opening 202.

The slide spring 188 urges the slide 50 forwardly toward the engaged position shown in FIG. 11. When the slide 50 is moved rearwardly to release a safety belt tongue, the spring 188 is compressed between the bridge portion 196 of the slide and the upstanding spring retaining posts 182 and 184 (see FIGS. 3 and 7). During this rearward movement of the slide 50, the spring mounting section 198 cooperates with the spring retaining posts 182 and 184 to guide movement of the slide. Thus, the spring retaining posts 182 and 184 have a pair of surfaces 220 and 222 which engage opposite sides of the spring mounting section 198 to guide movement of the slide 50 relative to the base 40.

Subassembly—Ejector

The ejector 54 ejects the safety belt tongue 22 (FIGS. 12 and 13) from the buckle 20. Thus, when the slide 50 is moved rearwardly and the latch bar 42 is pivoted to the release condition, the tongue 22 is released for movement out of the buckle 20. At this time, the ejector 54 moves forwardly from the retracted position of FIGS. 12 and 13 to the extended position of FIGS. 8 and 9 under the influence of the spring 56. As the ejector member 54 moves forwardly, the safety belt tongue 22 is ejected from the buckle.

When the ejector 54 is in the extended position of FIGS. 8 and 9, it blocks the entrance slot 68 (FIG. 4) through which the tongue is inserted into the buckle 20. This prevents dirt and foreign materials from entering the buckle. At this time, the detent 156 in the trailing edge portion 154 of the latch bar 42 engages the top of the ejector 54 (FIG. 9) to hold the latch bar in the release condition. This results in the slide 50 being held in the retracted position by engagement of the cam surface 208 with the latch bar tab 160 (FIG. 7). Since the ejector 54 blocks downward pivoting movement of the latch bar 42, the slide 50 is maintained in the position shown in FIG. 7 against the influence of the compressed slide spring 188.

When the safety belt tongue 22 is inserted into a buckle 20 and subassembly 36, the leading end of the tongue engages a recess 226 in the leading end of the actuator 54 (FIGS. 8 and 12). As insertion of the safety belt tongue 22 continues, the ejector 54 is forced to retract and the ejector spring 56 is compressed between the ejector and abutment 228 on the housing 58. Once the leading end of the opening 44 in the safety belt tongue 22 has cleared the trailing edge 154 of the latch bar 42, the slide 50 moves from the position shown in FIG. 7 to the position shown in FIG. 11 under the influence of the slide spring 188. This pivots the latch bar 42 from the release condition to the engaged condition. Of course, once the detent portion 156 of the latch bar 42 has engaged the opening 44 in the tongue 22 (FIG. 12) the tongue is held in the subassembly 36 against the influence of the ejector 54.

Housing

The tubular housings 58 and 98 for the top and end release buckles 20 and 28 enclose the subassembly 36. The housings 58 and 98 cooperate with the subassembly 36 to guide movement of the slide 50, guide movement of the ejector member 54, position the base 40 and slide 50 relative to each other, and to support either the actuator pad 24 or the actuator slide 32 for movement relative to the subassembly 36.

Figure 14:
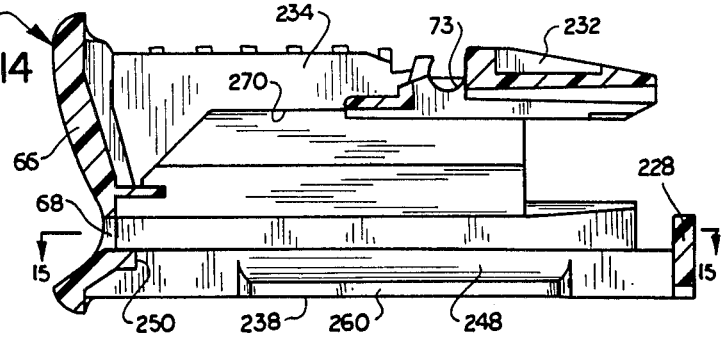
FIG. 14 is a sectional view of a tubular housing which partially encloses the subassembly of FIGS. 6–9 when it is used in a top release buckle.

The tubular housing 58 includes a top wall 232 (FIG. 14). The top wall 232 cooperates with the end wall 66 to define a rectangular opening 234 (FIG. 4). The actuator pad 24 is received in the opening 234. The upwardly facing recesses 72 and 73 (FIGS. 4 and 14) in the top wall 232 support the actuator pad 24 for pivotal movement relative to the housing 58.

Figure 15:
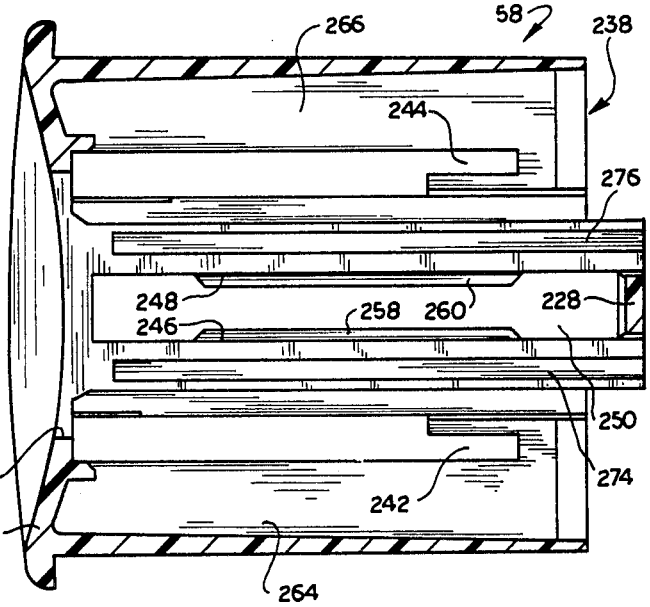
FIG. 15 is a plan view, taken generally along the line 15—15 of FIG. 14, further illustrating the construction of the housing.

A bottom wall 238 (FIG. 15) of the housing 58 has a pair of slots 242 and 244 into which the downwardly projecting mounting tangs 138 and 140 on the base 40 extend to hold the base against lengthwise movement relative to the housing. A pair of side surfaces 246 and 248 of a central slot 250 in the bottom wall 238 engage longitudinally extending edges 252 and 254 on the flanges 166 and 168 (see FIGS. 8 and 12) to position the base 40 relative to the housing 58. In addition, a pair of ledges 258 and 260 (FIGS. 14 and 15) project under the flanges 166 and 168 to press the subassembly 30 upwardly against the top wall 232 of the housing.

Movement of the slide 50 in the housing 58 is guided by a pair of guide tracks 264 and 266 (FIGS. 14 and 15) formed in the lower portion of the housing 58. In addition, a pair of guide tracks 270, only one of which is shown in FIG. 14, are formed in the housing to engage the upper portion of the slide 50. The guide tracks 264, 266 and 270 cooperate with the slide 50 to guide movement of the slide relative to the base 40.

Movement of the ejector 54 along the base 40 is guided by a pair of linear tracks 274 and 276 (FIG. 15) formed in the bottom wall 238. The tracks 274 and 276 are engaged by a pair of linear followers 278 and 280 on the bottom of the ejector 54 (FIGS. 8 and 11). In addition, movement of the ejector 54 is guided by engagement of the ejector with the flanges 166 and 168 and web portion 130 of the base 40.

Although the foregoing description has been in regard as to how the subassembly 36 cooperates with the housing 58 of the top release buckle 20, it should be understood that the subassembly 36 cooperates in substantially the same manner with the housing 98 for the end release buckle 28. Thus, the end release buckle housing 98 has tracks for guiding movement of the slide 50 and ejector 54 of the subassembly 36 and has surfaces for gripping the flanges 166 and 168 of the base 40 to position the base. In addition, the end release buckle housing 98 has an abutment, corresponding to the abutment 228 (FIGS. 8 and 15), which engages the inner end of the ejector spring 56.

Operation

Figure 16:
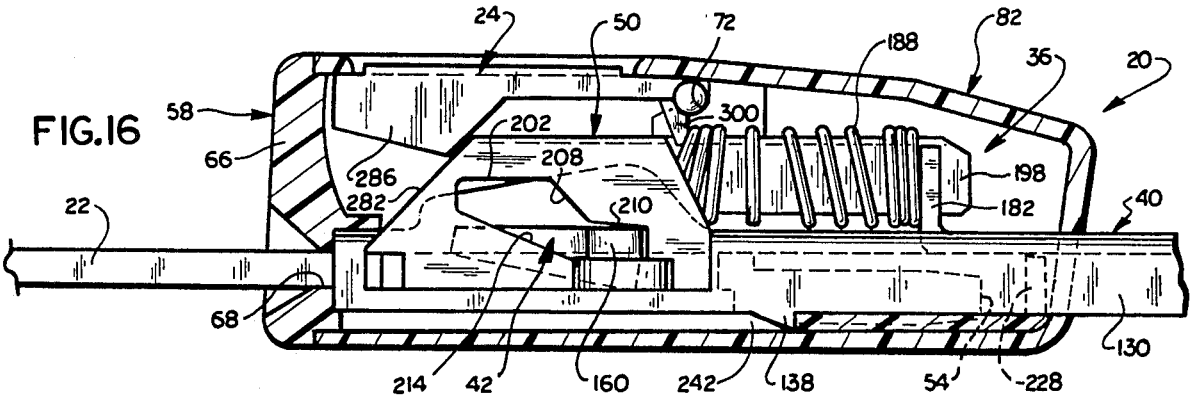
FIG. 16 is a sectional view of a top release buckle in which the subassembly of FIGS. 6–9 is disposed.

When the safety belt tongue 22 is in the top release buckle 20 (FIG. 16), the slide 50 is forward on the base 40. Downwardly and forwardly sloping drive surfaces 282 and 284 on the slide 50 (FIGS. 3, 6 and 16) engage downwardly projecting cam sections 286 and 288 on the actuator pad 24 (FIGS. 4 and 16). At this time, the actuator pad 24 is pressed firmly upwardly against the inner side surface of the cover 82 (FIG. 16) by the slide 50. The latch bar 42 is held in the engaged position by the blocking surfaces 210 on the slide 50.

Figure 17:
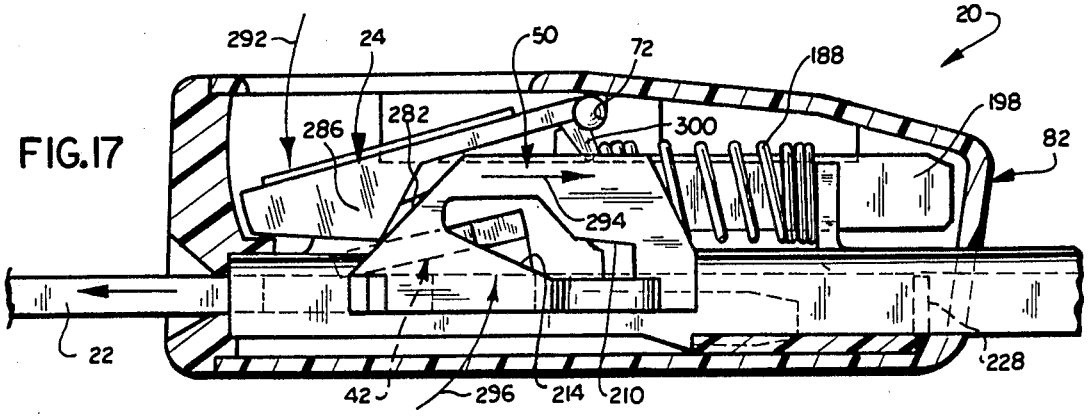
FIG. 17 is a sectional view illustrating the manner in which the top release buckle of FIG. 16 is actuated.

When the safety belt tongue 22 is to be withdrawn from the top release buckle 20, the actuator pad 24 is manually pivoted downwardly, in the manner indicated by the arrow 292 in FIG. 17. This downward movement of the actuator pad 24 presses the cam sections 286 and 288 against the downwardly and forwardly sloping drive surfaces 282 and 284 on the slide 50. The force applied against the slide 50 by the actuator pad 24 moves the slide rearwardly against the influence of the spring 188 in the manner indicated by the arrow 294 in FIG. 17.

As the slide 50 moves rearwardly, the latch bar 42 is cammed upwardly by the cam surface 214 in the manner indicated by the arrow 296 in FIG. 16. As this occurs, the latch bar 42 moves clear of the opening 44 in the tongue 22. The ejector 54 then moves forward to eject the tongue 22 from the buckle 20.

When the actuator pad 24 is in the initial position of FIG. 16, the coil spring 188 applies leftwardly directed forces against both the slide 50 and a tab 300 on the actuator pad 24. The spring force against the slide 50 holds the slide in the position shown in FIG. 16. At this time, the slide 50 blocks movement of the latch bar 42 from the engaged condition of FIG. 13. The spring force against the tab 300 tends to rotate the actuator pad 24 in a clockwise direction (as viewed in FIG. 16) so that the actuator pad is pressed against the cover 82.

As the actuator pad 24 is depressed, the tab 300 and actuator pad 24 pivot in a counterclockwise direction, as viewed in FIGS. 16 and 17. At the same time, the slide 50 moves rearwardly from the position shown in FIG. 16 to the position shown in FIG. 17. During this movement of the slide 50 and actuator pad 24, the spring 188 continuously urges them both back toward the positions shown in FIG. 16.

When the latch bar 42 has moved clear of the opening 44 in the safety belt tongue 22, the tongue is released for movement out of the buckle 20 under the influence of the ejector 54. As the safety belt tongue 22 moves out of the buckle 20, the ejector 54 moves forwardly to the position shown in FIG. 8 in which the ejector is beneath the latch bar 42.

Upon releasing of the actuator pad 24, the slide 50 moves through a very short distance toward the left (as viewed in FIG. 16) under the influence of the slide spring 188. This leftward movement of the slide results in the latch bar 42 being forced downwardly against the ejector 54. Engagement of the latch bar 42 with the ejector 54 then blocks continued leftward movement of the slide member 50. However, the end turns of the slide spring 188 continue to urge the actuator pad 24 to rotate in a clockwise direction to the initial position of FIG. 16. This results in the cam sections 286 and 288 on the actuator pad 24 moving away from the leading end of the slide 50.

When a safety belt tongue 22 is again inserted in the buckle 20, the leading end of the safety belt tongue forces the ejector 54 rearwardly against the influence of the spring 56. As the safety belt tongue 22 moves into the buckle 20, the opening 44 in the tongue moves into alignment with the latch bar 42. The latch bar 42 then pivots downwardly to thereby release the slide 50 for leftward movement to the position shown in FIG. 16 under the influence of the slide spring 188.

When the actuator slide 32 of the end release buckle 28 (FIGS. 2 and 5) is manually depressed, surfaces 310 and 312 (FIG. 5) of the slide 32 engage the drive surfaces 282 and 284 on the slide 50 to move the slide rearwardly. The end release buckle housing 98 is provided with linear tracks which engage the actuator slide 32 to guide movement of the actuator slide relative to the housing and the subassembly 36.

Summary

The present invention provides a subassembly 36 which can be used in either a top release buckle 20 having a manually movable actuator pad 24 in an upper portion of the buckle or an end release buckle 28 having a manually movable actuator slide 32 in one end portion of the buckle. The subassembly includes an elongated base 40 and a latch bar 42. The latch bar 42 is disposed in and projects outwardly of openings 144 and 146 formed in longitudinally extending side portions 132 and 134 of the base 40. A slide 50 engages the outwardly projecting end portions 160 and 162 of the latch bar 42 and is movable along the base 40 to move the latch bar between engaged and release conditions.

When the latch bar 42 is in the engaged condition holding a safety belt tongue 22 in the buckle 20, blocking surfaces 210 on the slide 50 block movement of the latch bar to the release condition. This prevents releasing of the safety belt tongue 22. Upon manual depression of either the actuator pad 24 in a top release buckle 20 or the actuator slide 30 in the end release buckle 28, the slide 50 is moved along the base 40 to move the latch bar 42 to the release condition and releases the safety belt tongue 22 or 30.

Having described a specific preferred embodiment of the invention, the following is claimed:

1. An apparatus for use in either a top release buckle having a manually movable actuator pad in an upper portion of the buckle or an end release buckle having a manually movable actuator slide in an end portion of the end release buckle, said apparatus comprising:

a base, a latch bar disposed on said base and movable between engaged and disengaged conditions in which said latch bar is effective to hold or release a tongue connected with a safety belt, slide means movable along said base for moving said latch bar between the engaged and disengaged conditions, said slide means including actuator surface means engageable by the actuator pad when said apparatus is used in a top release buckle and engageable by the actuator slide when said apparatus is used in an end release buckle, and spring means for urging said slide means toward a first position in which said latch bar is in the engaged condition, said slide means being movable along said base against the influence of said spring means from a first position to a second position to move said latch bar from the engaged condition to the disengaged condition under the influence of force applied against said actuator surface means by the actuator pad when said apparatus is used in a top release buckle and by the actuator slide when said apparatus is used in an end release buckle.

2. An apparatus for use in either a top release buckle having a manually movable actuator pad in an upper portion of the buckle or an end release buckle having a manually movable actuator slide in an end portion of the end release buckle, said apparatus comprising:

a base, a latch bar disposed on said base and movable between engaged and disengaged conditions in which said latch bar is effective to respectively hold or release a tongue connected with a safety belt;

slide means movable along said base for moving said latch bar between the engaged and disengaged conditions, said slide means including actuator surface means engageable by the actuator pad when said apparatus is used in a top release buckle and engageable by the actuator slide when said apparatus is used in an end release buckle; and spring means for urging said slide means toward a first position in which said latch bar is in the engaged condition, said slide means being movable along said base against the influence of said spring means from a first position to a second position to move said latch bar from the engaged condition to the disengaged condition under the influence of force applied against said actuator surface means by the actuator pad when said apparatus is used in a top release buckle and by the actuator slide when said apparatus is used in an end release buckle, said slide means including first and second cam surfaces for engaging opposite end portions of said latch bar and moving said latch bar from the engaged condition to the disengaged condition during movement of said slide means along the base under the influence of force applied against said actuator surface means by the actuator pad when said apparatus is used in a top release buckle and by the actuator slide when said apparatus is used in an end release buckle.

3. An apparatus as set forth in claim 2 wherein said slide means includes blocking surface means for blocking movement of said latch bar from the engaged condition when said slide means is in the first position.

4. An apparatus as set forth in claim 2 wherein said actuator surface means includes a first surface area adjacent to one end portion of said latch bar and a second surface area disposed adjacent to the other end portion of said latch bar, said first and second surface areas sloping at an acute angle to the direction of movement of said slide means along said base, said slide means being movable along said base from the first position to the second position under the influence of force components applied in a first direction against said first and second surface areas by the actuator pad when said apparatus is used in a top release buckle and being movable along said base from the first position to the second position under the influence of force components applied against said first and second surface areas in a second direction transverse to the first direction by the actuator slide when said apparatus is used in an end release buckle.

5. An apparatus as set forth in claim 4 wherein said slide means further includes first and second blocking surfaces for engaging opposite end portions of said latch bar and blocking movement of said latch bar from the engaged condition to the disengaged condition when said slide means is in the first position.

6. An apparatus as set forth in claim 5 further including ejector means for ejecting a tongue from a buckle upon movement of said latch bar from the engaged condition to the disengaged condition and for holding said latch bar in the disengaged condition until a tongue is inserted into a buckle.

7. An apparatus for use in either a top release buckle having a manually movable actuator pad in an upper portion of the buckle or an end release buckle having a manually movable actuator slide in an end portion of the end release buckle, said apparaturs comprising:

a base;

a latch bar disposed on said base and movable between engaged and disengaged conditions in which said latch bar is effective to hold or release a tongue connected with a safety belt;

slide means movable along said base for moving said latch bar between the engaged and disengaged conditions, said slide means including actuator surface means engageable by the actuator pad when said apparatus is used in a top release buckle and engageable by the actuator slide when said apparatus is used in an end release buckle; and spring means for urging said slide means toward a first position in which said latch bar is in the engaged condition, said slide means being movable along said base against the influence of said spring means from a first position to a second position to move said latch bar from the engaged condition to the disengaged condition under the influence of force applied against said actuator surface means by the actuator pad when said apparatus is used in a top release buckle and by the actuator slide when said apparatus is used in an end release buckle;

said base having an elongated configuration with a pair of side portions extending lengthwise of said base and a web portion extending between said side portions, said side portions of said base including surface means for a least partially defining a pair of apertures, said latch bar being supported in said apertures for movement between the engaged and disengaged conditions;

said latch bar extending across said base in a direction transverse to the longitudinal axis of said base and having a first end poriton projecting outwardly from one of the side portions of said base and a second end portion projecting outwardly from the other side portion of said base;

said slide means including a first cam surface disposed adjacent to the one side portion of said base and engageable with the first end portion of said latch bar and a second cam surface disposed adjacent to the other side portion of said base and engageable with the second end portion of said latch bar.

8. An apparatus as set forth in claim 7 further including a tubular housing extending around at least a portion of said base, first connector means for preventing relative movement between said housing and base, said slide means being disposed between said housing and base, said housing including surface means for guiding movement of said slide means relative to said base and housing, a cover enclosing at least a portion of said housing and base, said cover having an open end through which said housing and base are inserted into said cover, and second connector means for preventing relative movement between said housing and cover.

9. An apparatus as set forth in claim 7 wherein said side portions include a pair of inturned flange sections having inner side surfaces facing toward said web portion and extending parallel to the longitudinal axis of said base, said apparatus further including an ejector member disposed in abutting engagement with said inner side surfaces of said flange sections and slidable along said flange sections, and second spring means for effecting sliding movement of said ejector member along said flange sections to eject a tongue connected with a safety belt from a buckle upon movement of said latch bar to the disengaged condition with a tongue inserted in the buckle.

10. An apparatus as set forth in claim 7 wherein said actuator surface means includes a first actuator surface disposed adjacent to the one side portion of said base and engageable by a first surface on the actuator pad when said apparatus is used in a top release buckle and by a first surface on the actuator slide when said apparatus is used in an end release buckle, said actuator surface means including a second actuator surface disposed adjacent to the other side portion of said base and engageable by a second surface on the actuator pad when said apparatus is used in a top release buckle and by a second surface on the actuator slide when said apparatus is used in an end release buckle.

11. An apparatus as set forth in claim 10 wherein said slide means includes a first side section disposed adjacent to said first side portion of said base, a second side section disposed adjacent to said second side portion of said base, and a bridge section extending between said first and second side sections, said first cam surface and said first actuator surface being disposed on said first side section of said slide means, said second cam surface and said second actuator surface being disposed on said second side section of said slide means, said bridge section of said slide means being disposed in abutting engagement with and being slidable along an outer side surface of said web portion of said base.

12. An apparatus as set forth in claim 11 wherein said base further includes a spring retaining portion projecting from said outer side surface of said web portion of said base in a direction opposite to said side portions of said base, said spring means including a coil spring disposed adjacent to said outer side surface of said web portion and having a first end portion disposed in abutting engagement with said slide means and a second end portion disposed in abutting engagement with said spring retaining portion of said base.

13. An apparatus as set forth in claim 12 wherein said slide means further includes an elongated spring mounting section projecting from said bridge section of said slide means in a direction generally parallel to the longitudinal axis of said base, said spring retaining portion of said base including first and second guide surfaces disposed adjacent to opposite sides of said spring mounting section of said slide means to at least partially guide movement of said slide means relative to said base.

14. An apparatus as set forth in claim 13 further including an ejector member disposed between said side portions of said base and movable along an inner side surface of said web portion of said base, and second spring means for moving said ejector member along said web portion of said base to eject a tongue connected with a safety belt from a buckle upon movement of said latch bar to the disengaged condition with a tongue inserted in the buckle.

15. An apparatus as set forth in claim 13 wherein said slide means further includes first blocking surface means disposed on the first side section of said slide means for engaging the first end portion of said latch bar and second blocking surface means disposed on the second side section of said slide means for engaging the second end porton of said latch bar, said first and second blocking surface means blocking movement of said latch bar from the engaged condition to the disengaged condition when said slide means is in the first position.

16. A buckle for receiving a tongue connected with a safety belt, said buckle comprising:

an elongated base having a web portion and a pair of side portions which project in a first direction from said web portion and extend lengthwise of said base, a latch bar at least partially supported by said side portions for movement between an engaged condition in which said latch bar is effective to hold the tongue in said buckle and a disengaged condition, said latch bar having a first end portion projecting outwardly from one of the side portions of said base and a second end portion projecting outwardly from the other side portion of said base, and a slide member movable along said base between first and second positions, said slide member having surface means engageable with the first and second end portions of said latch bar to block movement of said latch bar from the engaged condition to the disengaged condition when said slide member is in the first position, said surface means being engageable with said first and second end portions of said latch bar to move said latch bar from the engaged condition to the disengaged condition during movement of said slide member from the first position to the second position.

17. A buckle as set forth in claim 16 wherein said web portion of said base has an inner side surface which faces in the first direction and an outer side surface which faces in a direction opposite to the first direction, said latch bar being disposed adjacent to the inner side surface of said web portion of said base, said slide member being disposed adjacent to the outer side surface of said web portion of said base.

18. A buckle for receiving a tongue connected with a safety belt, said buckle comprisings:

an elongated base having a web portion and a pair of side portions which project in a first direction from said web portion and extend lengthwise of said base;

a latch bar at least partially supported by said side portions for movement between an engaged condition in which said latch bar is effective to hold the tongue in said buckle and a disengaged condition, said latch bar having a first end portion projection outwarldy from one of the side portions of said base and a second end portion projection outwardly from the other side portion of said base; and a slide member movable along said base between first and second positions, said slide member having surface means engageable with the first and second end portions of said latch bar to block movement of said latch bar from the engaged condition to the disengaged condition when said slide member is in the first position, said surface means being engageable with said first and second end portions of said latch bar to move said latch bar from the engaged condition to the disengaged condition during movement of said slide member from the first position to the second position;

said web portion of said base having an inner side surface with faces in the first direction and an outer side surface with faces in a direction opposite to the first direction, said latch bar being disposed adjacent to the inner side surface of said web portion of said base;

said slide member being disposed adjacent to the outer side surface of said web portion of said base;

and said slide member having a first side section disposed adjacent to the first side portion of said base, a second side section disposed adjeent to the second side portion of said base, and a bridging section extending between said first and second side sections;

said surface means including a first cam surface disposed on the first side section of said slide member and engageable with the first end portion of said latch member during movement of said slide member from the first position to the second position, a second cam surface disposed on the second side of said slide member and engageable with the second end portion of said latch member during movement of said slide member from the first position to the second position, a first blocking surface disposed on the first side section of said slide member and enagageable with the first end portion of said latch member when said slide member is in the first position, and a second block surface disposed on the second side section of said slide member and engageable with the second end portion of said latch member when said slide member is in the first position.

19. A buckle as set forth in claim 18 wherein said first side section of said slide member includes a first opening in which the first end portion of said latch bar is disposed, said second side section of said slide member includes a second opening in which the second end portion of said latch bar is disposed, said first opening being at least partially defined by said first cam surface and said first blocking surface, said second opening being at least partially defined by said second cam surface and said second blocking surface.

20. A buckle as set forth in claim 18 wherein said first and second blocking surfaces extend parallel to the longitudinal axis of said base, said first and second cam surfaces being skewed at an acute angle to the longitudinal axis of said base.

21. A buckle as set forth in claim 18 further including spring means for urging said slide member toward the second position, said base including a spring retaining portion projecting from said outer side surface of said web portion, said spring means being compressed between said slide member and said spring retaining portion of said base upon movement of said slide member to the second position.

22. A buckle as set forth in claim 18 wherein said side portions of said base include a pair of flanges having inner side surfaces which extend parallel to the longitudinal axis of said base and which face toward the inner side surface of said web portion of said base, said buckle further including an ejector member disposed between the inner side surfaces of said flanges and the inner side surface of the web portion of said base, and ejector spring means for moving said ejector member along said base to eject the tongue from said buckle upon movement of said latch member from the engaged condition to the disengaged condition.

23. A buckle as set forth in claim 22 further including slide spring means for urging said slide member toward the first position, said ejector member having surface means for blocking movement of said latch bar from the disengaged condition to the engaged condition and movement of said slide member to the first position under the influence of said slide spring prior to insertion of the tongue into said buckle.

24. A buckle as set forth in claim 22 further including a tubular housing at least partially enclosing said base and slide member, said tubular housing having first guide track means for engaging said slide member and at least partially guiding movement of said slide member between the first and second positions, said tubular housing having positioning surface means for engaging said flanges to at least partially position said base relative to said housing.

25. A buckle as set forth in claim 24 wherein said tubular housing has second guide track means for engaging said ejector member and at least partially guiding movement of said ejector member relative to said base.

26. A buckle as set forth in claim 25 wherein said side portions of said base include a pair of tangs which engage said housing to retain said base against movement relative to said housing.

27. A buckle as set forth in claim 18 further including a housing at least partially enclosing said base and slide member, said housing having an end wall which extends across one end of said base, said end wall having surface means at least partially defining a narrow slot through which the tongue is inserted into said buckle, first connector means for connecting said base with said housing, a cover enclosing at least a portion of said housing and said base, said cover having an open end through which said housing and base are inserted into said cover, said open end of said cover including an end surface which is disposed in abutting engagement with said end wall of said housing, and second connector means for connecting said cover with said housing.

28. A buckle as set forth in claim 18 further including a tubular housing at least partially enclosing said base and slide member, an actuator pad pivotally supported by said housing, said actuator pad being disposed in abutting engagement with said slide member and being pivotal toward said base to move said slide member from the first position to the second position, a cover enclosing at least a portion of said housing and actuator pad, and means for interconnecting said base, housing and cover to hold them against movement relative to each other.

29. A buckle as set forth in claim 28 further including spring means for urging said slide member toward the first position and for urging said actuator pad to pivot in a direction away from said base.

30. A buckle as set forth in claim 18 further including a tubular housing at least partially enclosing said base and slide member, an actuator slide slidably supported by said housing for movement along a path extending parallel to the longitudinal axis of said base, a cover enclosing at least a portion of said housing and said actuator slide, and means for interconnecting said base, housing and cover to hold them against movement relative to each other.

31. A buckle for receiving a tongue connected with a safety belt, said buckle comprising:

a base, a latch bar disposed on said base and movable between an engaged condition in which said latch bar is effective to hold the tongue in said buckle and a disengaged condition, a slide movable along said base between first and second positions, said slide including cam surface means for moving said latch bar from the engaged condition to the disengaged condition upon movement of said slide from the first position to the second position, an actuator pad movable relative to said base from an initial position to an actuated position to move said slide from the first position to the second position, and spring means for urging said actuator pad toward its initial position and for urging said slide to its first position, said spring means including a single spring element having a first end portion disposed in abutting engagement with a stationary surface and a second end portion disposed in abutting engagement with said slide and with said actuator pad.

32. A buckle as set forth in claim 31 further including a tubular housing extending around at least a portion of said base and said slide, said housing including surface means for supporting said actuator pad for pivotal movement between the initial and actuated positions, said actuator pad being pivotal to said initial position under the influence of said spring means while said slide remains stationary relative to said base, said slide being movable relative to said base to said first position under the influence of said spring means while said actuator pad is in said initial position.

33. A buckle as set forth in claim 32 wherein said slide includes an elongated spring mounting section, said spring element being a coil spring which telescopically receives said spring mounting section.

34. A buckle as set forth in claim 33 wherein said base includes a spring retaining portion, said stationary surface being disposed on said spring retaining portion, said spring retaining portion including first and second guide surfaces disposed adjacent to opposite sides of said spring mounting section to at least partially guide movement of said slide relative to said base.

35. An apparatus for use in either a top release buckle having a manually movable actuator pad in an upper portion of the buckle or an end release buckle having a manually movable actuator slide in an end portion of the end release buckle, said apparatus comprising:

a base, a latch bar disposed on said base and movable between engaged and disengaged conditions in which said latch bar is effective to hold or release a tongue connected with a safety belt, slide means movable along said base for moving said latch bar between the engaged and disengaged conditions, said slide means including first surface means engageable by the actuator pad when said apparatus is used in a top release buckle and engageable by the actuator slide when said apparatus is used in an end release buckle, said slide means including second surface means spaced from said first surface means and engageable with said latch bar to move said latch bar from the engaged condition to the disengaged condition, and spring means for urging said slide means toward a first position in which said latch bar is in the engaged condition, said slide means being movable along said base against the influence of said spring means from a first position to a second position to press said second surface means against said latch bar and move said latch bar from the engaged condition to the disengaged condition under the influence of force applied against said first surface means by the actuator pad when said apparatus is used in a top release buckle and by the actuator slide when said apparatus is used in an end release buckle.

36. An apparatus as set forth in claim 35 wherein said slide means includes third surface means for engaging said latch bar and blocking movement of said latch bar from the engaged condition when said slide means is in the first position.

* * * * *